United States Patent [19]

Junkers

[11] 4,406,185

[45] Sep. 27, 1983

[54] UNIVERSALLY USABLE HYDRAULIC WRENCH FOR SIMULTANEOUSLY TIGHTENING OR LOOSENING TWO THREADED CONNECTORS

[76] Inventor: John K. Junkers, 7 Arrow Head La., Saddle River, N.J. 07458

[21] Appl. No.: 315,998

[22] Filed: Oct. 28, 1981

Related U.S. Application Data

[63] Continuation-in-part of Ser. No. 265,234, May 19, 1981, Pat. No. 4,387,611.

[51] Int. Cl.[3] ..... B25B 13/46

[52] U.S. Cl. ..... 81/57.39

[58] Field of Search ..... 81/57.36, 57.39

[56] References Cited

U.S. PATENT DOCUMENTS

| | | | |
|---|---|---|---|
| 4,027,560 | 6/1977 | Parker | 81/57.39 |
| 4,027,561 | 6/1977 | Junkers | 81/57.39 |
| 4,132,136 | 1/1979 | Wilmeth | 81/57.39 |
| 4,269,088 | 5/1981 | Dukes | 81/57.39 |
| 4,308,767 | 1/1982 | Wilmeth | 81/57.39 |

*Primary Examiner*—James L. Jones, Jr.

*Attorney, Agent, or Firm*—Michael J. Striker

[57] ABSTRACT

A hydraulically operated wrench for simultaneously tightening or loosening two threaded connectors comprises a drive unit including a cylinder and a piston reciprocatable therein and having a piston rod and a pair of transversely spaced side plates preferably releasably connected to the cylinder and projecting to one side of the latter. A plurality of differently constructed drive levers are provided to be selectively pivotally and releasably connected intermediate its ends to the side plates for pivoting about a first pivot axis and having each at one end a polygonal opening for engaging the polygonal member of a first threaded connector to be turned, whereas the opposite end of the respective drive lever is engaged by the piston rod to be tiltable about the first pivot axis at least during the forward stroke of the piston. A plurality of differently constructed drive links are further provided to be selectively and releasably connected at one end to the side plates for pivoting about a second pivot axis spaced from and parallel to the first pivot axis and each having at an opposite end a polygonal opening for engaging the polygonal member of a second threaded connector to be turned.

8 Claims, 8 Drawing Figures

UNIVERSALLY USABLE HYDRAULIC WRENCH FOR SIMULTANEOUSLY TIGHTENING OR LOOSENING TWO THREADED CONNECTORS

CROSS REFERENCE TO RELATED APPLICATIONS

The present application is a continuation-in-part of the copending application Ser. No. 265,234, filed May 19, 1981, now U.S. Pat. No. 4,387,611.

BACKGROUND OF THE INVENTION

There are many applications in which a plurality of threaded connectors, usually arranged spaced from each other along a circle, have to be tightened or loosened. Such applications are for instance abutting flanges of pipes in a pipeline, which are connected by bolts extending through aligned bores in the flanges of the pipes, or covers of atomic reactors which have to be tightly connected by a plurality of bolts. Up to now such bolts have been individually tightened, which is of course quite a time-consuming task. It is pointed out that hydraulic wrenches are rather heavy and, depending on the force such wrench has to apply, such hydraulic wrenches may weight up to 200 pounds and such heavy wrenches have to be lifted and lowered by crane to apply such wrenches to successive threaded connectors to be tightened or loosened. The set-up time for moving the wrench from one to the next threaded connector to be tightened or loosened may therefore take from 5 minutes up to half an hour. While for some special applications apparatus have already been provided by means of which several bolts or threaded connectors could be tightened or loosened simultaneously, in such known apparatus a separate fluid-operated driving element has to be used for tightening or loosening each bolt or any other threaded connector, and such apparatus is extremely complicated, heavy and expensive, so that the handlng thereof is likewise difficult.

Another factor essential for the construction of hydraulic wrenches, respectively whether a hydraulic wrench of usual construction can be applied at all, especially a hydraulic wrench for simultaneously tightening or loosening two threaded connectors, is that the spacing of threaded connectors which have to be tightened or loosened varies considerably as well as the available overhead space for applying a hydraulic wrench of a usual construction. In many applications, the available overhead space is so small that hydraulic wrenches of known construction could not be used, and in such cases box wrenches have been used to which hammer blows have been applied to tighten or loosen a threaded connector. Of course, in such cases, a proper tightening of the threaded connectors with a predetermined force could never be obtained.

SUMMARY OF THE INVENTION

It is an object of the present invention to provide a hydraulically operated wrench in which two threaded connectors may be simultaneously tightened or loosened, to thereby reduce considerably the time for tightening or loosening a great number of threaded connectors.

It is an additional object of the present invention to provide a hydraulic wrench for simultaneously tightening or loosening two threaded connectors regardless of the spacing of the two threaded connectors from each other.

It is a further object of the present invention to provide a hydraulic wrench for simultaneously tightening or loosening two threaded connectors which can be quickly adapted for operations in which the overhead space for applying the wrench is extremely limited.

With these and other objects in view, which will become apparent at the description proceeds, the hydraulic wrench according to the present invention for simultaneously tightening or loosening two threaded connectors mainly comprises a unit including cylinder-and-piston means having a cylinder, a piston reciprocatable in said cylinder between an active stroke and a return stroke and a piston rod fixed at one end to said piston and projecting at its other end beyond the cylinder, in which the unit further comprises connecting means connected to the cylinder and projecting to one side thereof, lever means provided in the region of one end thereof with means for engaging a polygonal member of a first threaded connector to be turned during the active stroke of the piston, first mounting means for releasably mounting the lever means intermediate its ends on the connecting means for tilting movement about a first pivot axis with the other end of the said lever means engaged by the other end of the piston rod, elongated link means provided in the region of one end with means for engaging a polygonal member of a second threaded connector, second mounting means for releasably mounting the other end of the link means on the connecting means for tilting movement about a second pivot axis parallel and transversely spaced from the first pivot axis, whereby when said means on said lever means is engaged with a polygonal member of a first threaded connector and said means on said link means is engaged with a polygonal member of a second threaded connector, said lever means will be tilted during the active stroke of said piston about the axis of the first threaded connector shifting thereby the cylinder and the connecting means substantially in the direction of the active stroke of the piston to tilt the link means about the axis of the second threaded connector so that the polygonal members of the first and the second threaded connector will be simultaneously turned, and whereby due to the releasable connection of the lever means and the link means to the connecting means differently constructed lever means and link means may be connected to the unit so that the latter may be used for different wrench applications.

To adapt the hydraulic wrench of the present invention to any spacing between the two threaded connectors which have to be tightened or loosened, the wrench includes further means on the connecting means and cooperating with the second mounting means for changing the distance between the first and the second pivot axes.

The connecting means comprise elongated side plate means, preferably releasably attached to the cylinder of the cylinder-and-piston means.

The aforementioned distance-changing means may comprise a plurality of bores in the plate means spaced in the distance of the elongation thereof from each other and the second mounting means may comprise a pin for releasably mounting the other end of the link means at a selected one of the spaced bores in the side plate means. On the other hand, the distance-changing means may comprise an elongated slot in the side plate means extending substantially parallel to the piston rod and locking means for releasably locking the second mounting means at a selected portion of the elongated slot. The last mentioned locking means may comprise an elongated rack extending substantially parallel to the slot and a locking device having teeth selectively engageable with the teeth of the rack.

The aforementioned lever means may comprise a first single elongated drive plate and the engaging means for engaging a polygonal member of a first threaded connector to be turned comprises in this case a polygonal opening at the one end of the first elongated drive plate and the link means in this case comprise a second single elongated drive plate and the engaging means thereof for engaging a polygonal member of a second threaded connector to be turned comprises a polygonal opening at the one end of the second elongated drive plate.

When such lever means and link means are connected to the unit of the wrench, the wrench is especially adapted for use in which the overhead space for applying the wrench is extremely limited. If the aforementioned constructed lever means and link means are connected to the connecting means of a wrench. This construction includes also between the other end of the piston rod and the other end of the lever means a member for tilting the lever means about the first pivot axis only during the active stroke of the piston.

On the other hand, a differently constructed lever means and link means may be attached to the connecting means and link means may be attached to the connecting means of the unit. Such differently constructed lever means may comprise a first pair of transversely spaced drive plates, a first ratchet gear mounted in the region of one end of the lever means for turning about an axis parallel to the first pivot axis, and first ratchet pawl means cooperating with the first rachet gear for turning the latter in one direction during the active stroke of the piston, and the engaging means for engaging a polygonal member of a first threaded connector being provided on the first ratchet gear. The link means in this case comprise a second pair of transversely spaced drive plates, a second rachet gear mounted in the region of one end of the link means for turning about an axis parallel to the second pivot axis and second pawl means cooperating with the second rachet gear for turning the same in one direction during the active stroke of the piston and shifting of the cylinder and the connecting means substantially in the directon of the active stroke. The engaging means for engaging a polygonal member of the second threaded connector being in this case provided on the second ratchet gear.

The first and the second ratchet gear are each provided with coaxial trunnions projecting to opposite sides of the respective ratchet gears and being respectively turnably mounted in the respective pair of side plates and the first and second engaging means in this case may comprise a polygonal opening extending through the respective ratchet gear and the trunnion thereof.

On the other hand, each of the ratchet gears and the trunnion thereof may be provided with a coaxial splined bore and each of the engaging means may comprise an elongated member having a splined portion engaged in the respective splined bore and a coaxial portion of square cross section projecting beyond one of the respective side plates for mounting thereon a standard socket for engagement with the respective polygonal member to be turned.

The last-mentioned construction may be used in applications in which a large overhead space for applying the wrench is available, and this construction has the advantage that sockets of different dimensions may be quickly placed on the square portion of the elongted member so that the wrench of the present invention may be used regardless of the size of the polygonal members to be turned.

By releasably mounting the lever means and the link means, and by supplying the user with differently constructed lever and link means, as mentioned above, only a single drive unit, that is a single cylinder-and-piston means, is necessary, and the wrench according to the present invention may be quickly adapted to any application regardless of the available overhead space or spacing of the two threaded connectors which have to be simultaneously tightened or loosened.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
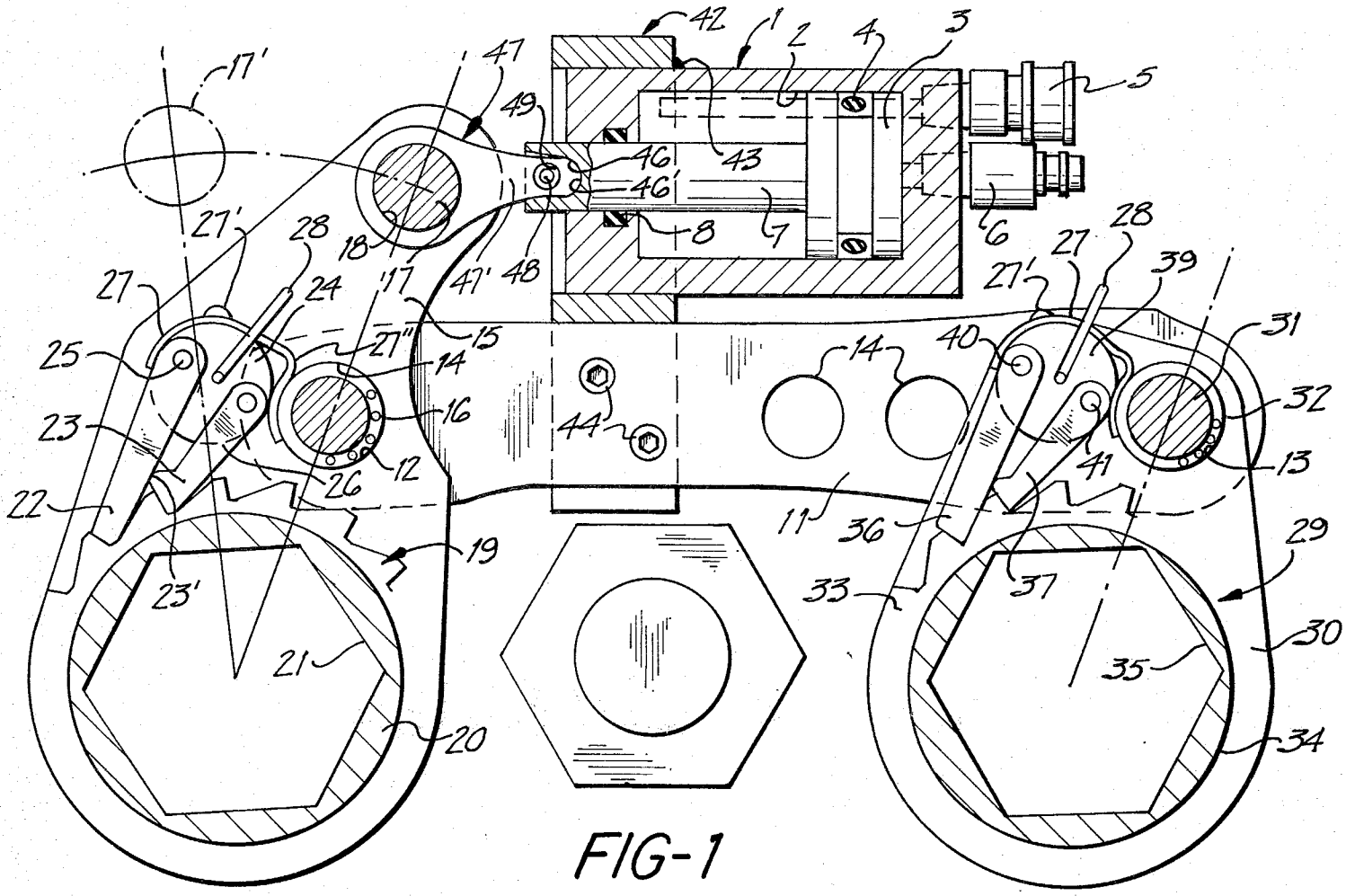
FIG. 1 is a sectional view of a first embodiment of a hydraulic wrench according to the present invention, the section being taken along the line I—I of FIG. 2.
Figure 2:
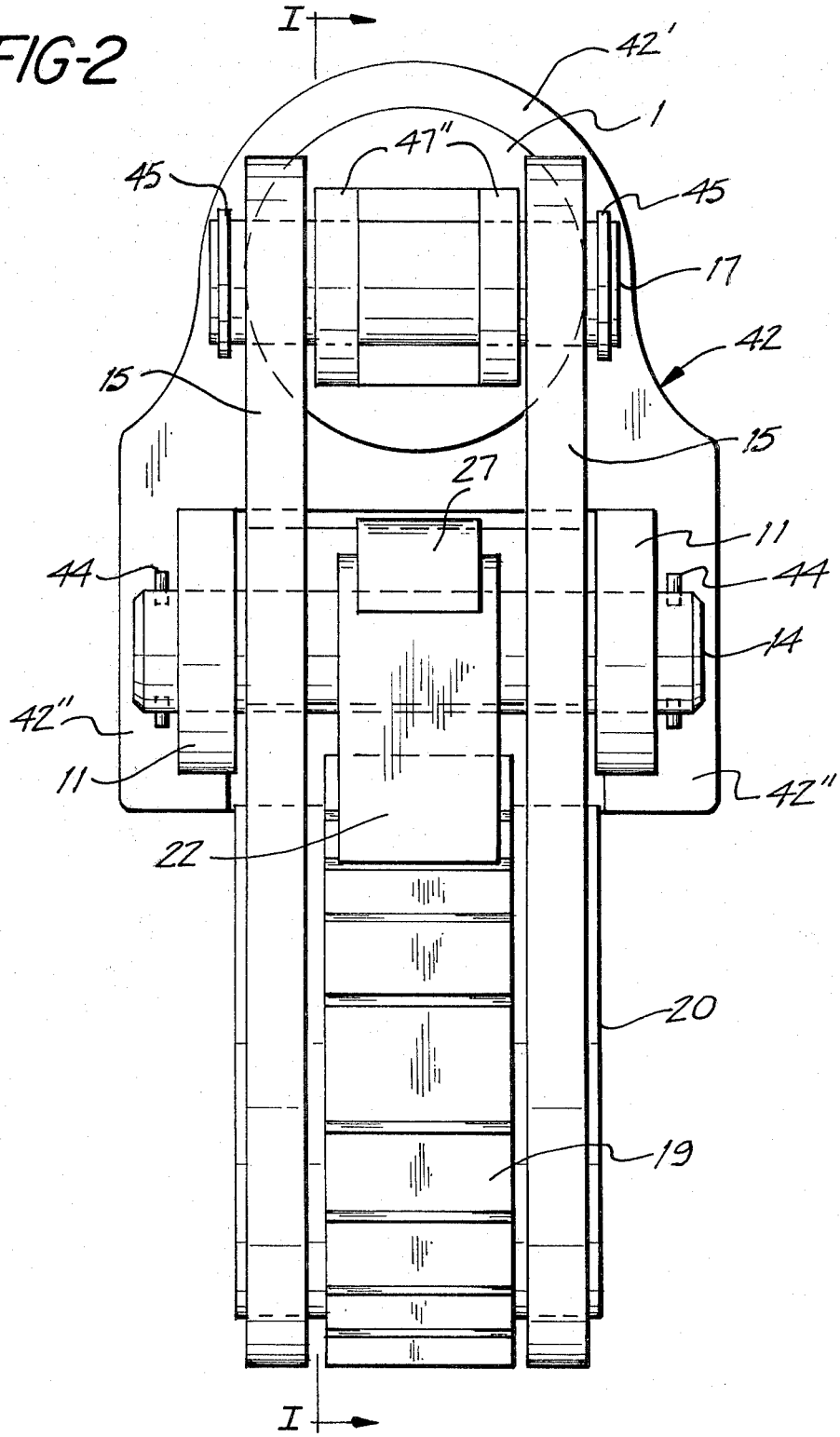
FIG. 2 is a front view of the embodiment shown in FIG. 1, as seen in the direction of the arrow A in FIG. 1.

Referring now to the drawing, and more specifically to FIGS. 1 and 2, in which a first embodiment of the hydraulic wrench according to the present invention is illustrated, it will be seen that this embodiment comprises a unit including fluid-operated cylinder-and-piston means, that is a cylinder 1 provided with a cylinder bore 2 in which a piston 3 provided with an annular seal 4 is reciprocable between an active stroke, towards the left as viewed in FIG. 1, and a return stroke. Nipples 5 and 6 are threadedly connected in corresponding bores in the right-hand end wall of the cylinder 1 and communicate through appropriate passages with opposite ends of the interior of the cylinder 1 for feeding, respectively discharging, pressure fluid in a known manner from a source, not illustrated in the drawing, into and from the cylinder to thereby reciprocate the piston between the active and the return stroke. A piston rod 7 is connected at one end in any suitable manner to the piston 3, concentric therewith, to project with its left end, as viewed in FIG. 1, sealed by sealing ring 8, through an opening in the left end wall of the cylinder 1 beyond the latter. The unit comprises further connecting means in the form of two transversely spaced side plates 11 projecting downwardly from one side of the cylinder as well as forwardly and rearwardly from the latter. The side plates 11 are preferably releasably connected to the cylinder 1 by means of a member 42 of a configuration as best shown in FIG. 2, which is attached to the peripheral surface of the cylinder 1 by an annular weld seam 43. The attaching member 42 has an annular portion 42' surrounding the peripheral surface of the cylinder 1 and two transversely spaced branches 42" extending downwardly from the annular portion 42' and respectively encompassing the side plates 11 on three sides thereof. The side plates 11 are connected to the branches 42" of the member 42 by a screw bolt 44, schematically indicated only in FIG. 1. The side plates 11 are provided in the region of the front ends thereof with aligned bores 12 and in the region of the rear or right ends thereof with aligned bores 13. Intermediate the bores 12 and 13 the side plates 11 are further provided with a plurality of bores 14 spaced in the longitudinal direction of the side plates, preferably through equal distances from each other, and preferably along a line connecting the centers of the bores 12 and 13 with each other. This embodiment may, as shown, comprise a pair of levers 15 releasably mounted between the side plates 11 by means of a pivot pin 14 extending through the aligned bores 12 in the side plates 11 and through needle bearings 16 press-fitted in corresponding bores provided in the levers 15 intermediate the ends thereof. The levers 15 are thus mounted on the side plates 11 for tilting about a first pivot axis, that is the axis of the pivot pin 14. The pivot pin 14 is secured against axial displacement by snap rings 44, provided at the ends of the pivot pin 14 projecting beyond the side plates 14, and by releasing the snap rings 44, the pivot pin 14 may be withdrawn so that the levers 15 may be exchanged against differently constructed levers, as will be pointed out later on. A further pin 17 extends through aligned bores 18 provided in the region of the upper ends of the levers 15. This pin 17 is likewise secured against axial displacement by snap rings 45 provided on opposite ends of the pin 17 projecting beyond the levers 15 and by releasing the snap rings 45 the pin 17 may be withdrawn from the bores 18. To connect the pin 17 with the piston rod 7, without imparting any bending moment to the latter, the front end of the piston rod 7 is provided with a cavity 46 having an inner concavely-shaped bottom portion 46' into which the stem portion 47' of a member 47 extends to abut with its rear end against the concavely-shaped bottom portion 46' of the cavity 46. The front end of the member 47 forms a U-shaped bracket having a pair of transversely spaced branches 47" provided with bores aligned with the bores 18 through which the pin 17 extends. The member 47 is secured in the cavity 46 by a pin or screw 48 which extends with clearance through a bore 49 in the stem portion 47' to assure that the end of the stem portion 47' can actually abut against the concavely shaped end portion 46' of the cavity 46.

A ratchet gear 19 is arranged in the region of the lower ends of the levers 15 between the latter and turnably mounted on these levers by means of a pair of trunnions 20 projecting to opposite sides of the gear 19 through correspondingly aligned bores in the levers 15.

Means for engaging a polygonal member of a first threaded connector to be turned during the active stroke of the piston 3 are provided at the lower ends of the levers projecting beyond the side plates 11. The engaging means of the construction shown in FIGS. 1 and 2 comprise a polygonal opening, for example a hexagonal opening 21, which extends coaxial with the ratchet gear 19 through the latter and the trunnions 20 projecting to opposite sides thereof for engagement with a corresponding polygonal portion of a first threaded connector to be turned. Preferably two ratchet pawls 22 and 23 are provided to engage with the lower ends thereof the teeth of the ratchet gear 19, whereas the upper ends of the pawls 22 and 23 are tiltably mounted in cut-outs of the cylindrical member 24 by means of pins 25 and 26. The member 24, in turn, has reduced-diameter portions extending to opposite sides thereof which are turnably mounted in appropriate bores of the levers 15. This arrangement, known per se from a copending application Ser. No. 225,408, will assure that the driving force created by the cylinder-and-piston means will be equally applied to adjacent teeth of the ratchet gear 19 to prevent the teeth from breaking. A leaf spring 27 is attached, for instance by a screw 27', to the cylindrical member 24 to engage the front or left face of the pawl 22 to hold the latter in engagement with the teeth of the ratchet gear 19, and the pawl 23 may be provided with a nose 23' engaging the rear or right face of the pawl 22 so that the spring 27 will also act on the pawl 23. The spring 27 is provided with an outwardly bulging portion 27" for the purpose to be described further below, and a fork-shaped lever 28 pivotally mounted at the center of the cylindrical member 24 is provided for cooperation with the bulging portion 27" in a manner to be described below.

The embodiment of the hydraulic wrench according to the present invention shown in FIGS. 1 and 2 includes further link means 29 which may comprise, a pair of plate-shaped links 30, of which only the rear one is shown in FIG. 1, which is arranged transversely spaced from each other between the side plates 11. The plate-shaped links 30 are releasably connected in the region of the upper ends thereof to the side plates 11 by a pivot pin 31 extending through the bores 13 in the side plates and through a needle bearing 32 press-fitted in corresponding bores of the link plates 30. The pivot pin 31 is secured against axial displacement in the same manner as the pivot pin 14 by snape rings, not shown in the drawing, and by releasing the snap rings the pivot pin 31 may be withdrawn so that the link plates 30 may be removed from the side plates 11 to be replaced by link means of other construction. A ratchet gear 33, of the same size and construction as the ratchet gear 19, is arranged between the link plates 30 and mounted turnable about its axis by means of coaxial trunnions 34 projecting from opposite sides of the ratchet wheel 33 through corresponding bores in the link plates 30. The link plates 30 are also provided at the ends thereof projecting beyond the side plates 11 with means for engaging a polygonal member of a second threaded connector and these engaging means are shown as being constituted by a hexagonal opening 35 coaxial with the axis of the ratchet gear and extending through the latter and the trunnions 34. The link means shown in the embodiment shown in FIGS. 1 and 2 include further two pawls 36 and 37 engaging with the lower ends thereof adjacent teeth of the ratchet gear 33, whereas the upper ends are tiltably mounted in cut-outs of a cylindrical member 39 by means of pins 40 and 41 in the same manner as described in connection with the pawl 22 and 23 cooperating with the ratchet wheel 19. The arrangement includes further another leaf spring 27 fastened by a screw 27' to the member 39 and cooperating with another forked lever 28 mounted on the member 39.

The above-described embodiment of the hydraulic wrench according to the present invention will operate as follows:

During the active stroke of the piston 3 in the cylinder 1, that is during the movement of the piston to the left, as viewed in FIG. 1, the pin 17 will, as assuming that the head of a first threaded connector is located in the hexagonal opening 21 and the head of second threaded connector is located in the opening 35, swing through an arc about the center of the opening 21 to the position 17' shown in dotted lines in FIG. 1, while the cylinder and the connecting means constituted by the side plates 11 will also move to the left due to the pivotal connection of the levers 15 with the side plates 11 by the pivot pin 14. This shifting movement of the connecting means of the side plates 11 will also shift the pivot pin 31 pivotally connecting the link means 29 to the side plates 11, so that the ratchet pawls 22 and 23 will turn the ratchet 19 and the ratchet pawls 36 and 37 will turn the ratchet gear 33 through equal angles and with the same turning moment if the distance between the center of the member 24 to the center of the ratchet gear 19 is equal to the center of the member 39 from the center of the ratchet gear 34, and if the plane including the axis of the member 24 and that of the ratchet gear 19 is parallel to the plane including the axis of the member 39 and that of the ratchet gears 33.

It sometimes happens that during the attempt to turn two threaded connectors simultaneously with the apparatus of the present invention that one of the threaded connectors engaged in the opening 21 or in the opening 35 is extremely hard to turn, so that the force provided by the cylinder-and-piston means is not sufficient to turn both of the threaded connectors simultaneously. In such a case, the operator may turn one of the levers 28 to engage the bulging portion 27'' of the respective spring 27, whereby the right arm of the spring is lengthened to engage the ratchet pawl 23 or 37 below the pivot point thereof, to lift the respective ratchet pawl out of engagement with the teeth of the respective ratchet gear, and correspondingly also the adjacent pawl so that the full force of the cylinder-and-piston means will be applied only to that ratchet gear in which the pawls still engage the teeth thereof. The other ratchet gear, which will not be turned in this case, serves then only to take up the reaction force during this operation.

If the spacing of the threaded connectors to be turned should be different from that shown in FIG. 1, the wrench can be easily adapted for such different spacings by simply removing the pivot pin 31 of the link means 29 and inserting the pivot pin 31 in another one of the bores 14. It is also possible to do so, even if the spacing of the threaded connectors to be turned is the same as shown in FIG. 1, in which case the moment applied to the threaded connector inserted in the opening 35 of the link means 20 will be different from the moment applied to the threaded connector inserted into the opening 21. By releasably connecting the lever means and the link means to the side plates 11, it is possible to easily remove the lever means and the link means from the apparatus to exchange the same for lever means and link means of different construction, so that the apparatus may be universally used.

By releasably connecting the side plates 11 to the cylinder 1, it is also possible to exchange the side plates 11 by different side plates having for instance different spacing between the bores 14, if such should be necessary in accordance with the spacing between adjacent threaded connectors to be simultaneously turned.

Figure 3:
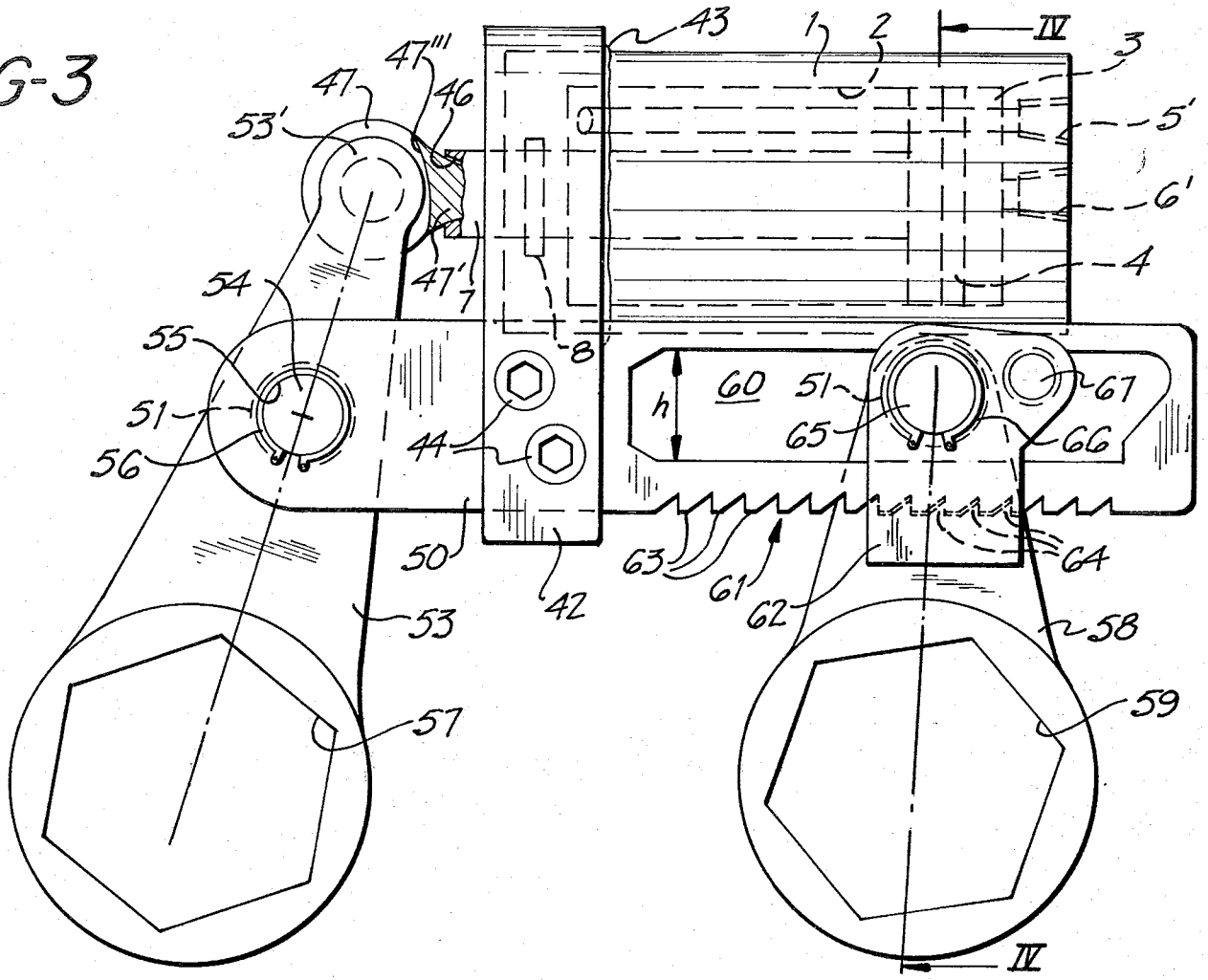
FIG. 3 is a side view of a second embodiment of a hydraulic wrench according to the present invention.
Figure 4:
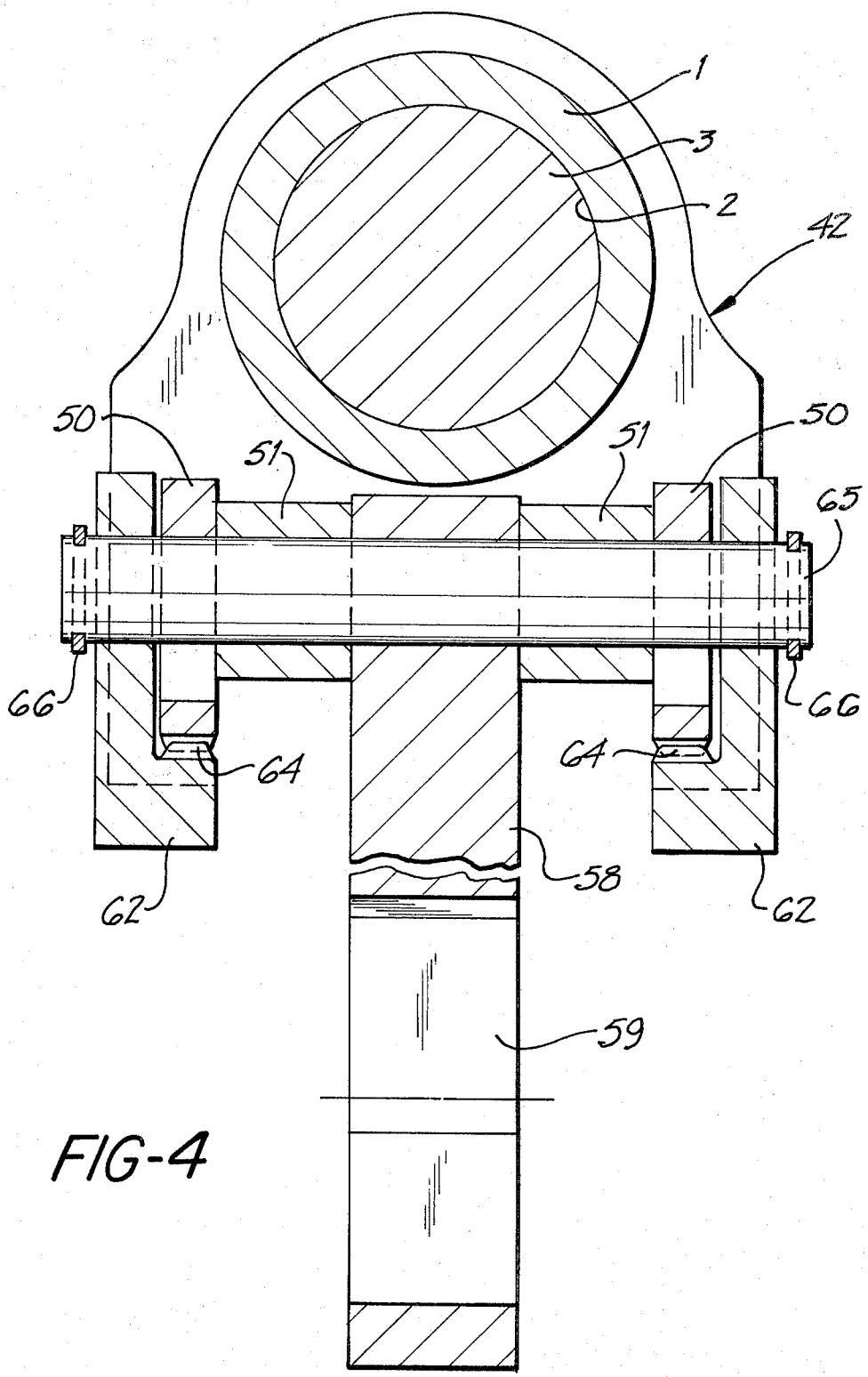
FIG. 4 is a section of the embodiment shown in FIG. 3, the section being taken along the line IV—IV of FIG. 3.

A second embodiment according to the present invention is shown in FIGS. 3 and 4 in which lever means and link means differing from those shown in FIGS. 1 and 2 are illustrated, which are especially suitable for applications in which the overhead space for applying the wrench to threaded connectors is extremely limited.

The embodiment shown in FIGS. 3 and 4 again comprises a unit including a cylinder 1 provided with a coaxial cylinder bore 2 in which a piston 3 is reciprocatable between an active stroke and a return stroke. Threaded tapered bores 5' and 6' are provided in the right end wall of the cylinder 1 for threadingly connecting nipples 5 and 6 as shown in FIG. 1 and bores 5' and 6' communicate through appropriate passages with opposite ends of the interior of the cylinder 1 for feeding, respectively discharging, pressure fluid in a known manner from a source, not illustrated in the drawing, into and from the cylinder to thereby reciprocate the piston 3 between the active and the return stroke. The piston 3 is again provided with a sealing ring 4. A piston rod 7 is connected at one end in any suitable manner to the piston 3 concentric therewith to project with its left end, as viewed in FIG. 3, sealed by sealing ring 8, through an opening in the left end wall of the cylinder 1 beyond the latter.

The hydraulic wrench according to the present invention shown in FIGS. 3 and 4 includes also a pair of transversely spaced side plates 50, which are however of different construction, as will be pointed out later on, from the side plates 11 shown in FIGS. 1 and 2. The side plates 50 are again releasably connected to the cylinder 1 by a member 42 which is of the same construction as the member 42 shown in FIGS. 1 and 2 and likewise connected by a weld seam 43 to the peripheral surface of the cylinder 1. The side plates 50 are respectively releasably connected to the branch portions of the member 42 by screws 44, shown only in FIG. 3 and omitted for simplification reasons in FIG. 4. In embodiment shown in FIGS. 3 and 4 there are illustrated lever means 53 which, however, are different from the lever means 15 shown in the embodiment of FIGS. 1 and 2, in that the lever means 53 are constituted by a single elongated drive plate located between the side plates 50. Means are provided for releasably mounting the single elongated drive plate 53 intermediate its ends in the region of the left end portion, as viewed in FIG. 3, of the side plates 50. This releasable mounting means of the single drive plate 53 includes a pin 54 which projects through transversely aligned bores 55 in the side plates 50 and preferably a needle bearing, as shown at 16 in FIG. 1, press-fitted in a corresponding bore of the lever 53. The pin 54 is secured against axial displacement again by snap rings 56 provided at opposite ends of the pin 54 projecting beyond the side plates 50 and by releasing the snap rings 56 the pin 54 may be axially withdrawn to thereby disconnect the single drive lever 53 from the side plates 50. The left end portion, as viewed in FIG. 3, of the piston rod 7 is again provided with a cavity 46, only partly shown in FIG. 3, but of the same configuration as described in connection with the embodiment illustrated in FIGS. 1 and 2. The stem portion 47', only partly shown in FIG. 3, of a member 47 extends again into the cavity 46 and is connected therein in the same manner as described in connection with FIG. 1. The member 47 shown in FIG. 3 is of the same construction as the member 47 shown in FIGS. 1 and 2, but the upper rounded end 53' of the single drive lever 53 is located between the branches 47" of the member 47 and is not connected to these branches by a pin 17 as shown in FIG. 1, but the upper rounded end 53' of the single drive lever 53 will abut during the active stroke of the piston 3 only against the abutment face 47"' of the member 47. The single drive lever 53 is again provided in the region of its lower end projecting beyond the side plate 50 with engaging means for engaging a first threaded connector to be turned, and this engaging means comprise a polygonal, preferably hexagonal, opening 57 extending through the single drive lever 53.

The embodiment shown in FIGS. 3 and 4 also comprises link means which are shown as being constituted by a single link plate 58, the upper end portion of which is located between the side plates 50. The link plate 58 is provided in the region of its lower end portion, projecting beyond the side plates 50, with engaging means for engaging a polygonal member of a second threaded connector to be turned, and this engaging means is again constituted by a polygonal, preferably hexagonal, opening 59 through the single link plate 58.

The side plates 50 in the embodiment shown in FIGS. 3 and 4 are of different construction than the side plates 11 shown in FIG. 1, and different means are provided in the side plates 50 for changing the transverse distance between the single drive plates 53 and the single link plate 58 in dependence on the distance of the two threaded connectors to be simultaneously turned. The distance-changing means in this embodiment comprise an elongated slot 60 provided in each of the side plates 50 extending in the longitudinal direction thereof, and the bottom face of each side plate 50 is formed as a rack 61 having adjacent downwardly extending teeth 63 of a configuration as best shown in FIG. 3. A pair of locking members 62 of a cross section, as best shown in FIG. 4, have upwardly extending teeth 64 engaging the downwardly extending teeth 63 of the rack 61. The upper end of the single link plate 58 is releasable and pivotally connected by a pivot pin 65 extending through aligned bores in the two locking members 62 and a corresponding bore in the single link member 58. The pivot pin 65 is releasably held against axial displacement by a pair of snap rings 56 provided at the ends of the pivot pins 65 projecting beyond the locking members 62 and by releasing the snap rings 66 the pivot pin 65 may be withdrawn in axial direction so that the single link plate 58 may be disconnected from the side plates and replaced by different link member, for instance a different polygonal opening. It will be noted that the pivot pin 65 has a diameter which is smaller than the height h of the slot 60 provided in each of the side plates 50 by a dimension at least equal to the height of the teeth 63. The pin 65 may therefore be lowered in the slots 60, and therewith the locking members 62 may also be lowered to disengage the teeth 64 on the locking members from the teeth 63 of the rack 61, and the locking members 61 together with the link plate 58 connected by the pivot pin 65 thereto may be shifted in axial direction of the slot 60 to thereby change the distance between the pivot pins 54 and 65. The two locking members 62 are further connected to each other by a stepped distance bolt 67 having a larger diameter portion between the locking members 62 and a smaller diameter portion extending through appropriate bores in the locking members 62 and releasably connected thereto in any suitable manner.

Since the space between the side plates 50 is wider than the width of the single link plate 58 to accommodate also link means of different construction, for instance as shown in FIGS. 1 and 2, between the side plates, spacer sleeves 51 are provided between the side plates 50 and the single link plate 58 to hold the latter centrally between the side plates. It is to be understood that such spacer sleeves 51 are also provided between the side plates 50 and the single lever plate 53, which is to be of the same width as the single link plate 58.

The embodiment illustrated in FIGS. 3 and 4 will operate as follows:

Assuming a polygonal member of a first threaded connector to be turned is engaged in the opening 57 of the single drive plate 53 and a polygonal member of the second threaded connector to be simultaneously turned with the first threaded connector is engaged in the opening 59 of the single link plate 58, the drive plate 53 will be tilted during the action stroke of the piston 3 about the axis of the polygonal member engaged in the opening 57 in counterclockwise direction, which in turn will shift the cylinder 1 and the side plates 50 connected thereto in the direction of the active stroke due to the connection of the drive plate 53 to the side plates by the pivot pin 54. This in turn will shift the locking members 62 in the same direction to thereby tilt the link plate 58 likewise in counterclockwise direction about the axis of the second threaded connector engaged in the opening 59, so that both threaded connectors will be simultaneously turned. It is pointed out that, during this operation, a reaction force is imparted to the cylinder 1 and the side plates 50 connected thereto, tending to tilt the same in clockwise direction so as to hold the teeth 63 of the rack 61 in positive engagement with the teeth 64 on the locking members 62.

At the return stroke of the piston 3 in the cylinder, the drive plate 53 and the link plate 58 will remain in the titlted position obtained during the active stroke of the piston, and, if the polygonal members engaged in the openings 57 and 59 should not be sufficiently tightened during a single stroke of the piston, the drive plate 53 and the link plate 58 have to be disengaged from the respective polygonal members, and the drive plate 53 and the link plate 58 have to be turned by hand then back to the position shown in FIG. 3 and subsequently reengaged with the two polygonal members to be further turned during the next active stroke of the piston 3. Preferably, the reciprocation of the piston 3 in the cylinder bore 2 is to be stopped in a manner known in the art during each return stroke of the piston.

Evidently, the embodiment shown in FIGS. 3 and 4 may also be used with a pair of drive levers 15 as shown in FIGS. 1 and 2 and a ratchet gear 19 therebetween as well as with a pair of link plates 29 with a ratchet gear 33 therebetween, and in this case the spacer sleeves 51 have to be removed from the pivot pins 54 and 65 so that the aforementioned members may be accommodated between the side plates 50. In this case, of course, the member 47 has to be connected by a pin 17, as shown in FIG. 1, to the upper ends of the lever plates 15 so that the same are tilted back and forth during the active and return strokes of the piston.

It is likewise evident that the embodiment shown in FIGS. 1 and 2 may be used with a single lever plate 53 and a single link plate 58 as shown in the embodiment illustrated in FIGS. 3 and 4, in which case spacer sleeves 51, as best shown in FIG. 4, have to be placed between the side plates 50 and the single lever plate 53, respectively between the side plate and the single link plate 58.

Figure 5:
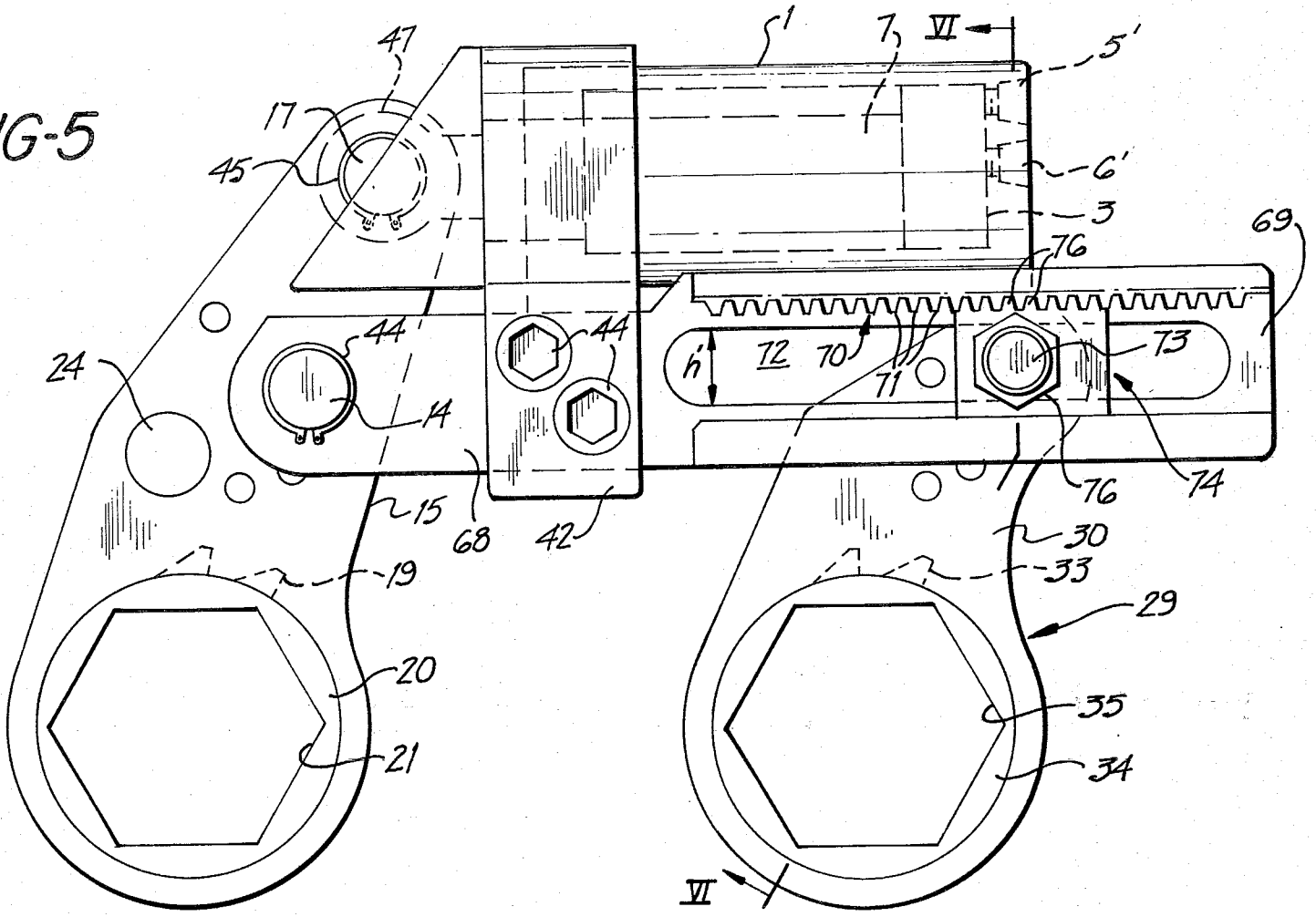
FIG. 5 is a side view of a third embodiment of a hydraulic wrench according to the present invention.
Figure 6:
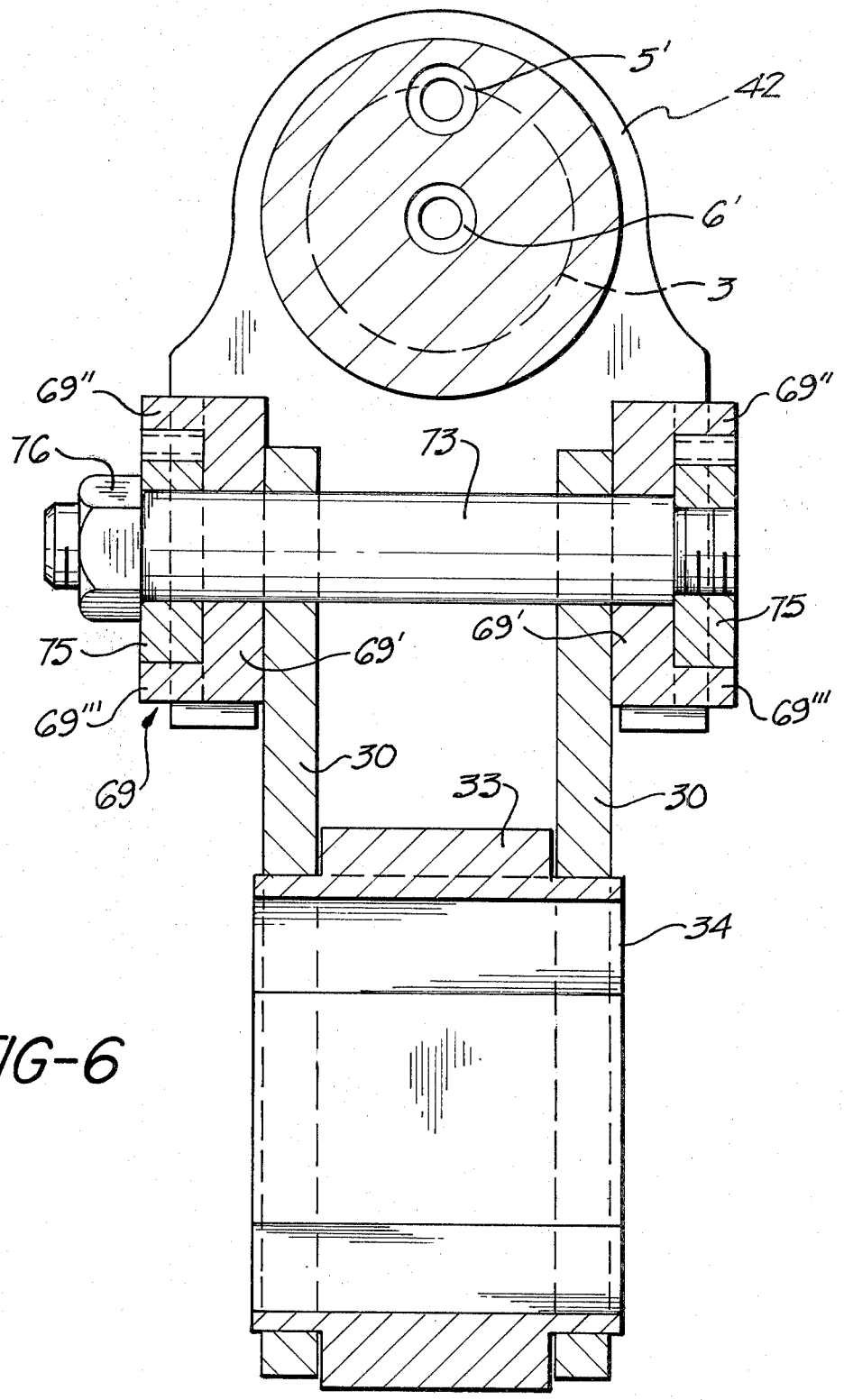
FIG. 6 is a section of the embodiment shown in FIG. 5, the section being taken along the line VI—VI of FIG. 5.

The embodiment shown in FIGS. 5 and 6 differs from the embodiment shown in FIGS. 1 and 2 only by the distance-changing means, that is the means for changing the distance between the pivot pin 14 at which the lever plates 15 are connected to the side plate and the distance of the pivot pin at which the link plates 30 are connected to the side plates. In the embodiment shown in FIGS. 5 and 6, the side plates 68, which are connected by the member 42 to the cylinder 1, have a different configuration than that of the embodiment shown in FIGS. 1 and 2, and the distance-changing means are not constituted by a plurality of transversely spaced bores 14 as shown in FIG. 1, but these distance-changing means are also differently constructed, as will be described in the following.

As shown in FIGS. 5 and 6, the side plates 68 have to the right side, as viewed in FIG. 5 of the bracket or attaching member 42 an elongated portion 69 of substantially U-shaped configuration having each, as best shown in FIG. 6, a vertically extending long arm 69', from the upper and lower ends of which short arms 69'', respectively 69''', extend in outward direction. At least the arm 69' of each side plate 69 is provided with a rack portion 70 having downwardly extending teeth 71, as best shown in FIG. 5. The side plate portions 69 are further each provided, as best shown in FIG. 5, with a longitudinally extending slot 72 having a height h'. In order to connect the pivot pin 73, which releasably and pivotally connects the upper ends of the link plates 30 at variable distances from the pivot pin 14 to the side plate portions 69, a locking device 74 is provided which comprises two plates 75 respectively located between the short arms 69' and 69''' of each side plate 69 and each of these plates 75 has at least along the upper face thereof teeth 76 meshing with corresponding teeth 71 of the rack 70. The pivot pin 73 is connected to one of the locking plates 75, by being for instance threadingly connected thereto, as shown at the right side of the pivot pin 73 as viewed in FIG. 6, whereas the other end of the pivot pin 73 extends through the locking plate 75 shown at the left side of FIG. 6 and with a threaded portion beyond the latter, onto which a nut 76 is screwed, so that the two locking plates 75 are securely held in place. If it is now desired to change the distance between the pivot pins 14 and 73, the nut 76 is unscrewed, the pivot pin 73 as well as the locking plate 75 threadingly connected thereto are withdrawn to the right, as viewed in FIG. 6, whereafter the locking plate 75 at the left side, as viewed in FIG. 6, may be withdrawn from between the teeth of the corresponding side plate portions 69, subsequently be reengaged at a selected distance with the teeth of the rack 70, whereafter the pivot pin 73 with the other locking plate 75 threadingly attached thereto is reengaged in the bore of the adjusted locking plate 75, and finally the nut 76 again tightened on the projecting threaded portion of the pivot pin 73. In this embodiment the diameter of the pivot pin 73 is substantially equal to the height of the slot h', that is the pivot pin 73 fits with a slide fit in the slots 72 provided in both of the side plate portions 69.

The operation of the embodiment shown in FIGS. 5 and 6 is the same as the operation of the embodiment shown in FIGS. 1 and 2 described above.

It is also to be mentioned that this embodiment shown in FIGS. 5 and 6 could also be used with a single lever plate 53 and a single link plate 58, as described in connection with the embodiment shown in FIGS. 3 and 4, in which, of course, spacer sleeves 51 as best shown in FIG. 4 have to be provided between the side plates 68 and the single lever plate 53 along the pivot pin 14 and corresponding spacer sleeves 51 on the pivot pin 73 between the side plate portions 69 and the single link plate 58.

Figure 7:
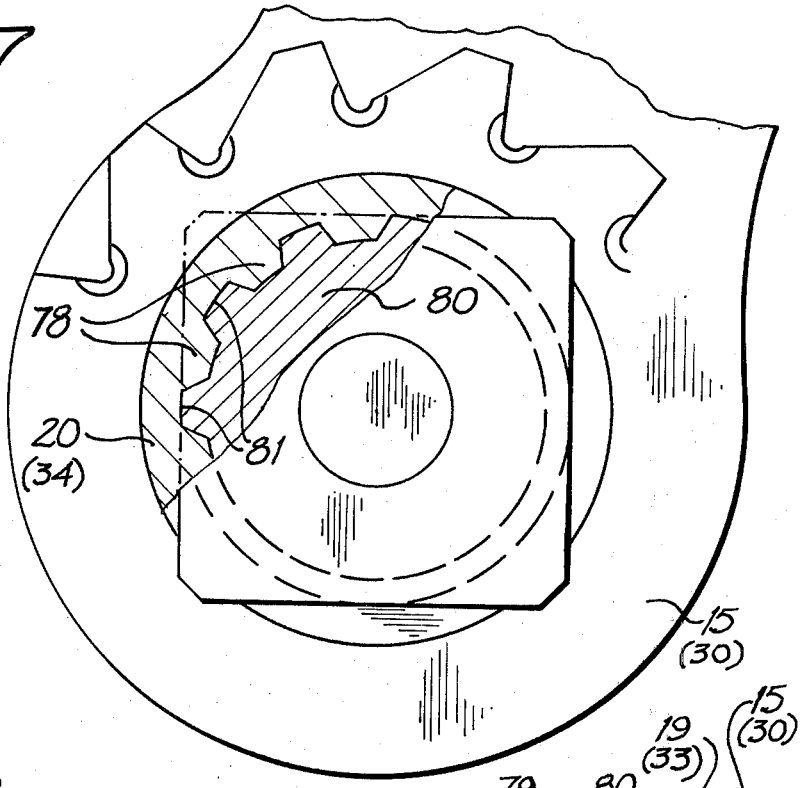
FIG. 7 is a partly sectioned side view illustrating part of a further modification.
Figure 8:
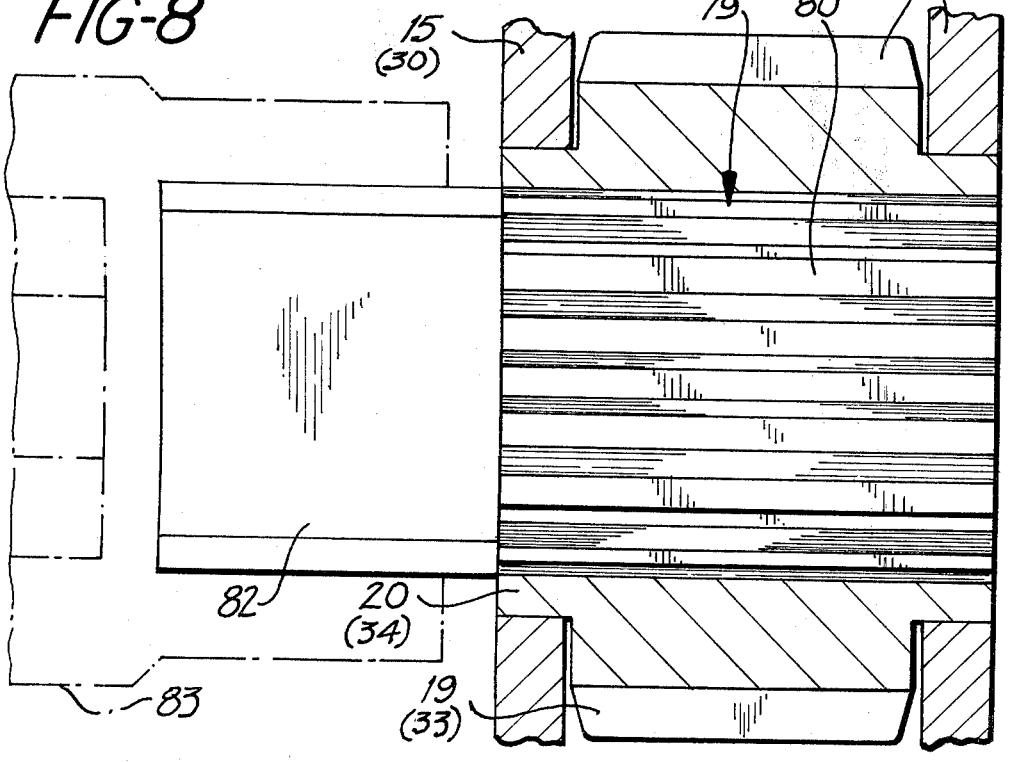
FIG. 8 is a partly sectional front view of a part of the modification shown in FIG. 7.

A modified engaging means for engaging the polygonal member of a first and a second threaded connector to be turned during the active stroke of the piston is shown in FIGS. 7 and 8. This arrangement, as shown in these Figures, may be used whenever a relatively large overhead space for applying the wrench to the polygonal members is available and whenever in any of the previously described embodiments two lever plates with a ratchet gear therebetween and two link plates likewise with a ratchet gear therebetween are used. In this case, each ratchet gear 19 or 33 and the trunnions 20, respectively 34, are provided with a circular opening therethrough, from which a plurality of uniformly peripherally-spaced splines 78 project radially inwardly. This construction includes further a shaft 79 having a first portion 80 provided with a plurality of corresponding outwardly extending splines 81 meshing in between the interstices between the splines 78 and a second portion 82 projecting beyond one of the trunnions 20 or 34 and having a square cross section on which a standard socket 83, as indicated in dash-dot lines in FIG. 8, may be exchangeably placed. In this way, the hydraulic wrench according to the present invention may be quickly adapted for simultaneously turning polygonal members of different sizes of first and second threaded connectors.

It will be understood that each of the elements described above, or two or more together, may also find a useful application in other types of hydraulic wrenches for simultaneously tightening or loosening two threaded connectors different from the types described above.

While the invention has been illustrated and described as embodied in a hydraulic wrench for simultaneously tightening or loosening two threaded connectors and which can be quickly adapted for use regardless of the overhead space available for applying the wrench and the spacing between the two threaded connectors to be tightened or loosened, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hydraulic wrench for simultaneously tightening and loosening two threaded connectors comprising a unit including cylinder-and-piston means having a cylinder and a piston reciprocatable in said cylinder between an active stroke and a return stroke, said unit comprising further connecting means including a pair of transversely spaced elongated side plates releasably attached to and projecting from said cylinder; lever means provided in the region of one end thereof with means for engaging a polygonal member of a first threaded connector to be turned during the active stroke of said piston; first mounting means for releasably mounting said lever means intermediate its ends on said connecting means for tilting movement about a first pivot axis with the other end of said lever means operatively connected to said piston; elongated link means provided in the region of one end with means for engaging a polygonal member of a second threaded connector, a portion of said lever means and the other end of said link means being located between said pair of side plates; second mounting means for releasably mounting the other end of said link means on said connecting means for tilting movement about a second pivot axis parallel to and transversely spaced from said first pivot axis; and means on said connecting means and cooperating with said second mounting means for changing the distance between said first and said second pivot axes, said distance changing means comprising a plurality of transversely aligned bores in said side plates respectively spaced in the direction of the elongation of said side plate from each other, and said second mounting means comprising a pin extending through a bore at said other end of said link means and to opposite sides of the latter into selected ones of said transversely aligned bores in said side plates, whereby when said means on said lever means is engaged with the polygonal member of the first threaded connector and said means on said link means is engaged with the polygonal member of the second threaded connector, said lever means will be tilted during the active stroke of the piston about the axis of said first threaded connector shifting thereby said cylinder and connecting means substantially in the direction of said active stroke to tilt said link means about the axis of the second threaded connector so that the polygonal member of the first and the second threaded connector will be simultaneously turned, and whereby due to the releasable connection of said lever means and said link means with said connecting means differently constructed lever means and link means may be connected to said unit so that the latter may be used for different wrench applications.

2. A hydraulic wrench as defined in claim 1, wherein said lever means comprises a first pair of transversely spaced drive plates located between said side plates, a first ratchet gear mounted in the region of said one end of said lever means between said first pair of transversely spaced drive plates for turning about an axis parallel to said first pivot axis and first ratchet pawl means cooperating with said first ratchet gear for turning the latter in one direction during the active stroke of said piston, said engaging means for engaging a polygonal member of a first threaded connector being provided on said first ratchet gear, and wherein said link means comprises a second pair of transversely spaced drive plates located between said side plates, a second ratchet gear mounted in the region of said one end of said link means between said second pair of transversely spaced drive plates thereof for turning about an axis parallel to said second pivot axis and second pawl means cooperating with said second ratchet gear for turning the same in one direction during the active stroke of said piston and shifting of said cylinder and said connecting means substantially in the direction of the active stroke, said engaging means for engaging a polygonal member of a second threaded connector being provided on said second ratchet gear.

3. A hydraulic wrench as defined in claim 2, wherein said first and second ratchet gear are each provided with coaxial trunnions projecting to opposite sides of the respective ratchet gear and being respectively turnably mounted in the respective pair of drive plates, and wherein said first and second engaging means comprises a polygonal opening coaxial with the respective ratchet gear and extending through the respective ratchet gear and the trunnions thereof.

4. A hydraulic wrench as defined in claim 2, wherein said first and said second ratchet gear are each provided with coaxial trunnions projecting to opposite sides of the respective ratchet gear and respectively turnably mounted in the respective pair of drive plates, each of said ratchet gears and said trunnions thereof being provided with a coaxial bore of non-circular cross section, and wherein said engaging means comprises an elongated member having a first portion of non-circular cross section complementary to that of said bore and tightly engaged therein and a coaxial portion of square cross section projecting beyond one of the respective drive plates for mounting thereon a standard socket for engaging with the respective polygonal member to be turned.

5. A hydraulic wrench as defined in claim 2, wherein said first and second ratchet gear are each provided with coaxial trunnions projecting to opposite sides of the respective ratchet gear and respectively turnably mounted in the respective pair of drive plates, each of said ratchet gears and said trunnions thereof being provided with a coaxial splined bore, and wherein said engaging means comprises an elongated member having a splined portion engaged in the respective spline bore and a coaxial portion of square cross section projecting beyond one of the respective drive plates for mounting thereon a standard socket for engaging with the respective polygonal member to be turned.

6. A hydraulic wrench for simultaneously tightening and loosening two threaded connectors comprising a unit including cylinder-and-piston means having a cylinder and a piston reciprocatable in said cylinder between an active and a return stroke, said unit comprising further connecting means comprising elongated side plate means releasably attached to and projecting from said cylinder; lever means provided in the region of one end thereof with means for engaging a polygonal member of a first threaded connector to be turned during the active stroke of said piston; first mounting means for releasably mounting said lever means intermediate its ends on said connecting means for tilting movement about a first pivot axis with the other end of said lever means operatively connected to said piston; elongated link means provided in the region of one end with means for engaging a polygonal member of a second threaded connector; second mounting means for releasably mounting the other end of said link means on said connecting means for tilting movement about a second pivot axis parallel to and transversely spaced from said first pivot axis; and means on said connecting means and cooperating with said second mounting means for changing the distance between said first and said second pivot axes, said distance changing means comprising an elongated slot in said side plate means extending substantially parallel to the direction of the stroke of said piston and locking means for releasably locking said second mounting means at a selected portion of said slot, said locking means comprising an elongated rack extending substantially parallel to said slot and a locking device having teeth selectively engageable with teeth of said rack, said second mounting means comprising a pin extending through said slot and tiltably and releasably mounting said other end of said link means on said locking means, whereby when said means on said lever means is engaged with the polygonal member of the first threaded connector and said means on said link means is engaged with the polygonal member of the second threaded connector, said lever means will be tilted during the active stroke of the piston about the axis of said first threaded connector shifting thereby said cylinder and connecting means substantially in the direction of said active stroke to tilt said link means about the axis of the second threaded connector so that the polygonal members of the first and the second threaded connector will be simultaneously turned, and whereby due to the releasable connection of said lever means and said link means with said connecting means differently constructed lever means and link means may be connected to said unit so that the latter may be used for different wrench applications.

7. A hydraulic wrench as defined in claim 6, wherein said pin has a diameter smaller than the width of said slot by a dimension which is at least equal to the height of said teeth of said locking device.

8. A hydraulic wrench as defined in claim 6, wherein said pin has a diameter substantially equal to the width of said slot.

* * * * *